US005678131A

United States Patent [19]

Alexandrovich et al.

[11] Patent Number: 5,678,131

[45] Date of Patent: Oct. 14, 1997

[54] APPARATUS AND METHOD FOR REGULATING TONING CONTRAST AND EXTENDING DEVELOPER LIFE BY LONG-TERM ADJUSTMENT OF TONER CONCENTRATION

[75] Inventors: Peter S. Alexandrovich, Rochester; Allen J. Rushing, Webster, both of N.Y.

[73] Assignee: Eastman Kodak Company, Rochester, N.Y.

[21] Appl. No.: 629,693

[22] Filed: Apr. 9, 1996

[51] Int. Cl.[6] ..... G03G 21/00

[52] U.S. Cl. ..... 399/58; 399/60; 399/61

[58] Field of Search ..... 355/246, 245, 355/208; 118/688–694; 399/24, 30, 48, 49, 58, 59, 62, 60, 61

[56] References Cited

U.S. PATENT DOCUMENTS

| | | | |
|---|---|---|---|
| 3,615,395 | 10/1971 | Yamaji . | |
| 4,310,237 | 1/1982 | Gengelbach . | |
| 4,350,435 | 9/1982 | Fiske et al. . | |
| 4,451,137 | 5/1984 | Farley . | |
| 4,531,832 | 7/1985 | Kroll et al. . | |
| 4,607,944 | 8/1986 | Rushing . | |
| 4,611,905 | 9/1986 | De Schamphelaere . | |
| 4,647,184 | 3/1987 | Russell et al. . | |
| 4,847,659 | 7/1989 | Resch, III . | |
| 4,853,738 | 8/1989 | Rushing . | |
| 4,875,078 | 10/1989 | Resch, III et al. . | |
| 4,908,666 | 3/1990 | Resch, III . | |
| 4,949,135 | 8/1990 | Ng . | |
| 5,003,327 | 3/1991 | Theodoulou et al. . | |
| 5,047,802 | 9/1991 | Donivan et al. . | |
| 5,122,842 | 6/1992 | Rimai et al. . | |
| 5,204,699 | 4/1993 | Birnbaum et al. . | |
| 5,410,388 | 4/1995 | Pacer et al. . | |
| 5,436,705 | 7/1995 | Raj | 399/30 X |
| 5,532,794 | 7/1996 | Tokuyama et al. | 399/58 X |

*Primary Examiner*—S. Lee
*Attorney, Agent, or Firm*—Norman Rushefsky

[57] ABSTRACT

In an electrostatographic process wherein images are formed on an electrostatic image supporting medium and developed by a development station having a developer formed of a mixture of toner and carrier particles, there is provided apparatus for controlling various processing control parameters in response to formation of a toned patch on the medium. The apparatus includes a first feedback controller that processes signals related to the parameter toning contrast in accordance with a closed loop control of this parameter. The first feedback controller serves as a toning contrast controller and outputs a first signal representing toner concentration set point in response to closed loop control of toning contrast. The apparatus also includes a second feedback controller means that is slaved to the first feedback controller and serves as a toner concentration (TC) controller. The TC controller is responsive to sensing of toner concentration in the development station and to the first signal for controlling toner concentration in accordance with closed loop control of toner concentration. The TC controller outputs a second signal in response to closed loop control of toner concentration for use in controlling replenishment of toner to the development station and thereby controls toning contrast. The master slave feedback relationships of the two controllers allows long-term changes in toning contrast to be compensated by adjustment of toner concentration set point and may thereby permit for longer effective developer life.

19 Claims, 6 Drawing Sheets

APPARATUS AND METHOD FOR REGULATING TONING CONTRAST AND EXTENDING DEVELOPER LIFE BY LONG-TERM ADJUSTMENT OF TONER CONCENTRATION

CROSS-REFERENCE TO RELATED APPLICATION

This application is related to U.S. application Ser. No. 08/635,867 filed on Apr. 18, 1996 in the name of Allen J. Rushing and entitled "In-Station Calibration of Toner Concentration Monitor and Replenisher Drive".

BACKGROUND OF THE INVENTION

1. Field of the Invention

This invention relates to the field of electrostatography and, more particularly, to improvements in apparatus and methods for controlling toner replenishment.

2. Description of the Prior Art

In electrostatography, electrostatic images formed on a dielectric recording element are rendered visible via the application of pigmented, thermoplastic particles known as toner. Typically, such toner forms part of a two-component developer mix consisting of the toner particles and magnetically-attractible carrier particles to which the toner particles adhere via triboelectric forces. During the development process, the electrostatic forces associated with the latent image act to strip the toner particles from their associated carrier particles and the partially denuded carrier particles are returned to a reservoir.

It is well known in the art to continuously monitor the toner concentration in an electrostatographic developer mix and to replenish the mixture with toner when the concentration thereof falls below a predetermined level. Such a toner concentration monitor can be easily calibrated to compensate for toner depletion from the development system regardless of cause. Its significant drawback is that it is relatively slow to respond to abrupt changes in toner depletion rate, such as occasioned by a change in the image content of the documents being printed from ones having little image information thereon to ones having large solid or continuous toner image areas. Typically, several minutes will elapse before the toner concentration is restored to a level at which copies of a desired image density can be obtained.

It is also known in the art to continuously monitor toner depletion from an electrostatographic development station by monitoring the mount of toner applied to the recording member during development. For example, U.S. Pat. No. 3,674,353, issued to Trachtenberg, a pair of induction plates, positioned adjacent the recording member on the upstream and downstream sides of the development station, function to sense the overall charge on the recording member before and after development. The difference in charge induced on the plates by the passage of the undeveloped and developed charge patterns has been found to be an accurate measure of the quantity of toner depleted from the development station. A toner depletion signal, proportional to the difference in charge induced on the induction plates, is used to control toner replenishment.

Another method for continuously monitoring toner depletion from a development station is useful in electronic printers. The replenishing rate is adjusted in response to the number of character print signals applied to the printhead.

The print signals may be in character code and a statistical average take-out rate used to estimate toner depletion, or the signals may be picture elements (pixel) signals. See for example, U.S. Pat. Nos. 3,529,546 and 4,413,264.

While such toner depletion monitors are quicker to respond than are toner concentration monitors, their use for controlling toner replenishment has certain disadvantages. For example, any toner depletion aside from that caused by image development (e.g. dusting and other losses), is not sensed by such a monitor and, hence, cannot be accounted for by replenishment. Nor can such a monitor detect and cure inaccuracies or defects in the toner replenishment process. In short, toner depletion monitors are difficult, at best, to calibrate for precise control of toner replenishment.

Thus, previous approaches to process control in electrostatographic machines have typically involved adjustments to primary charging, toning station Vbias, and/or exposure, as required to regulate density. In such machines the toner replenishment is generally designed to maintain a fixed toner concentration (TC).

A deficiency of the fixed TC approach is that excessively large cumulative adjustments of charging and/or exposure may be required to compensate the effects on print density of age, environment, duty cycle, etc.

There are, on the other hand, some known machines that attempt to regulate density solely by toner replenishment, i.e., changing TC in the toning station.

A deficiency of relying exclusively on a variable TC to regulate density is that TC cannot be adjusted quickly. Increasing TC is rate limited by the size of the developer load and a limited replenishment rate. Decreasing TC is rate limited by the toner takeout rate of the images, which can be very slow for low percent toner coverage. Another disadvantage is that an extremely large TC range may be required to fully compensate the effects of age, environment, and duty cycle. Finally, rapid addition of toner, or withholding toner for long times, are both prone to cause problems, such as improper developer tribocharging or dusting.

Another approach to TC control regulates toning contrast (D/V), adjusting toner replenishment and changing TC as required to regulate D/V to a constant value. Previous configurations for this last approach (U.S. Pat. Nos. 4,847,659 and 4,908,666) have controlled TC in conjunction with $D_{max}$. With $D_{max}$ regulated by adjusting $V_o$, TC is adjusted so that the $V_o$ level required to hold $D_{max}$ on target is a target $V_o$. When both $D_{max}$ and $V_o$ are on target, the ratio $D_{max}/V_o$ is a fixed value. However, the actual toning contrast is not accurately represented by $D_{max}/V_o$ if either $V_B$ or $V_F$ is variable wherein $V_F$ is photoconductor voltage just after exposure.

A more general expression for toning contrast is given by $D/(V_{bias}-V_F)$. In addition, it is often desirable to monitor D/V from test patch measurements where the test patch nominal density is less than Dmax. Lower density test patches use less toner, and are easier to clean from the photoconductor if they are not transferred to a receiver.

In one embodiment disclosed in U.S. Pat. No. 4,875,078, a process variable such as toning contrast (D/V) is employed in lieu of a toner monitor for maintaining a constant TC. This approach requires a toning contrast controller that is tuned aggressively to regulate TC. Even so, because the electrometer and densitometer measurements needed to compute toning contrast are downstream from the toning station, toning contrast is a lagging indicator of TC. Thus, TC control is not as effective as in a system employing a TC monitor. In addition, aggressive tuning of the controller implies that a strong response is likely for duty cycle and environmental effects and can cause short-term extremes in TC.

Furthermore, the previous configurations have not limited the rate of change of TC, so that undesirable short-term changes in TC could occur, causing inconsistent toner tribocharging and dusting. Nor were the previous configurations designed to prolong developer life.

With any of these previous approaches, developer mixes eventually need to be replaced prematurely, owing to excessive dusting and background toner particles on the prints.

SUMMARY OF THE INVENTION

In view of the foregoing discussion, an object of this invention is to provide a toner replenishment control apparatus which overcomes the aforementioned disadvantages of prior art systems.

In accordance with a first aspect of the invention, there is provided for use in a electrostatographic machine wherein images are formed on an electrostatic image supporting medium and developed by a development station having a developer formed of a mixture of toner and carrier particles, the machine including apparatus for controlling various processing control parameters in response to formation of toned areas on the medium, the apparatus comprising a first feedback control means for processing signals related to the parameter toning contrast in accordance with a closed loop control of said parameter, said first feedback control means including means for outputting a first signal in response to closed loop control of said parameter; and a second feedback control means slaved to said first feedback control means and responsive to sensing of toner concentration in said development station and to said first signal for controlling toner concentration in accordance with closed loop control of toner concentration, said second feedback control means outputting a second signal in response to closed loop control of toner concentration for use in controlling replenishment of toner to said development station and thereby controlling toning contrast.

In accordance with a second aspect of the invention, there is provided a method for use in an electrostatographic process wherein images are formed on an electrostatic image supporting medium and developed by a development station having a developer formed of a mixture of toner and carrier particles, the method comprising the steps of exposing the member at an area to form a latent image, developing the image at a development station; in response to a characteristic of said image controlling the parameter toning contrast in forming said image in accordance with closed loop feedback control of signals related to said parameter and outputting a first signal in response to said closed loop control of said signals related to said parameter; sensing toner concentration in said development station; in response to sensing of toner concentration in said development station and in response to said first signal controlling toner concentration in said development station and thereby controlling toning contrast by outputting a second signal that is generated in response to closed loop feedback control of signals related to toner concentration.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein.

DESCRIPTION OF THE PREFERRED EMBODIMENT

Because apparatus of the general type described herein are well known the present description will be directed in particular to elements forming pan of, or cooperating more directly with, the present invention.

To facilitate understanding of the foregoing, the following terms are defined:

$V_B$=Development station electrode bias.

$V_O$=Primary voltage (relative to ground) on the photoconductor just after the charger. This is sometimes referred to as the "initial" voltage.

$V_F$=Photoconductor voltage (relative to ground) just after exposure.

$E_O$=Light produced by the print head.

E=Actual exposure of photoconductor. Light $E_O$ produced by the print head illuminates the photoconductor and causes a particular level of exposure E of the photoconductor.

In general contrast and density control are achieved by the choice of the levels of $V_O$, $E_O$, and $V_B$ as is well known and described in the published literature.

Another term used herein is "toning contrast", by which is meant the ratio of the output density D to the absolute value of the difference between $V_B$ and $V_F$ corresponding preferably to a region of density less than maximum although the invention contemplates use of regions of maximum density. A more precise value of toning contrast is obtained by first subtracting from the measured value $V_F$ an expected value, $D_d$, representing "dark decay" between electrometer measurement and toning. Since there will be a small time lapse between when an exposed photoconductive recording member is measured by the electrometer and when it reaches the toning zone, the $V_F$ for toning will not be identical with measured $V_F$ and the difference may be attributed to dark decay and the expected value thereof approximated. The term "toning contrast" as generally referred to herein contemplates use of either the more precise or the less precise calculated values for toning contrast.

Figure 1:
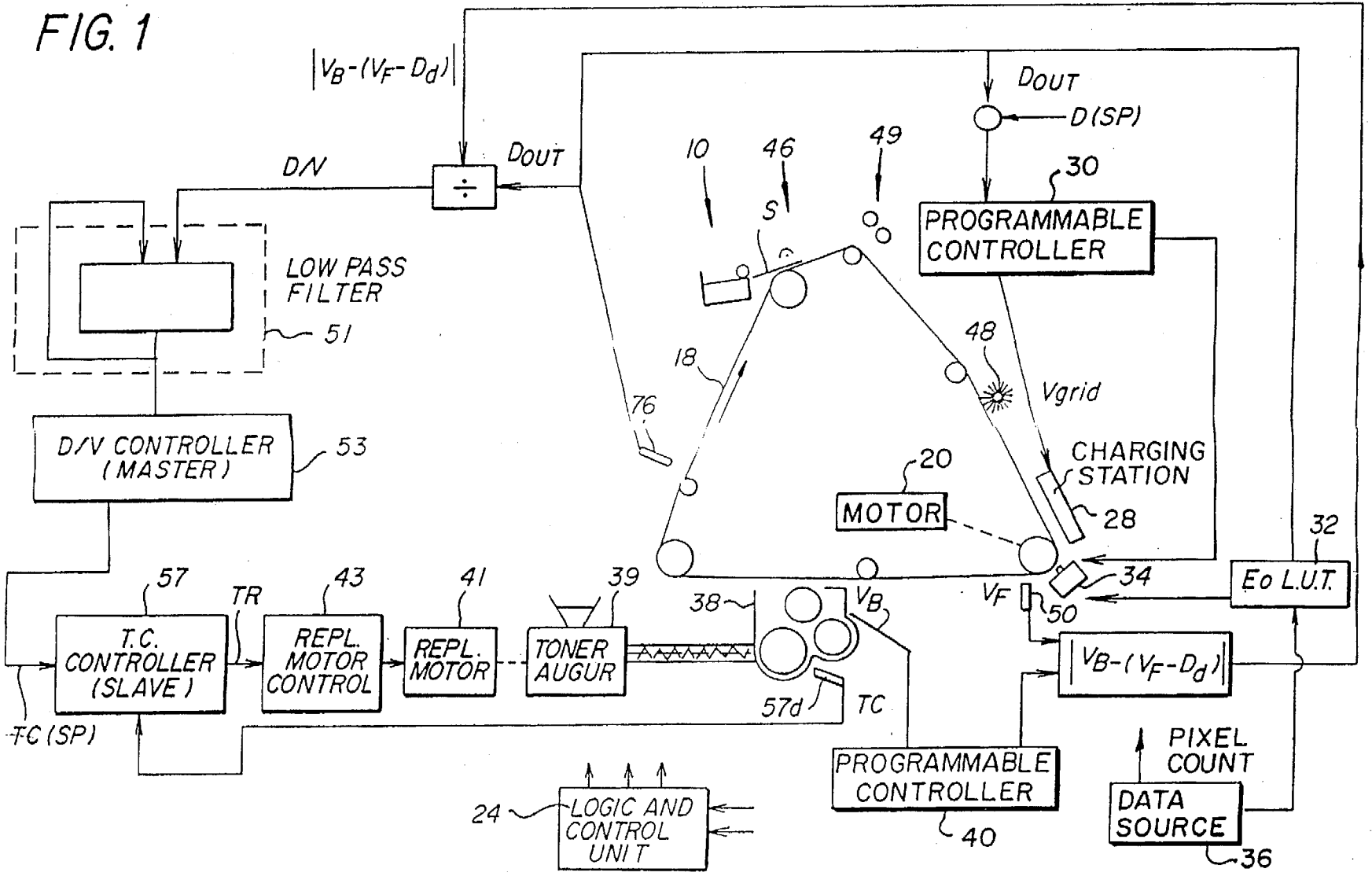
FIG. 1 is a schematic showing a side elevational view of an electrostatographic machine in accordance with a preferred embodiment of the invention.

With reference to the machine 10 as shown in FIG. 1, a moving recording member such as photoconductive belt 18 is driven by a motor 20 past a series of work stations of the printer. A logic and control unit (LCU) 24, which has a digital computer, has a stored program for sequentially actuating the work stations.

Briefly, a charging station 28 sensitizes belt 18 by applying a uniform electrostatic charge of predetermined primary voltage $V_0$ to the surface of the belt. The output of the charger is regulated by a programmable controller 30, which is in turn controlled by LCU 24 to adjust primary voltage $V_0$ for example through control of electrical potential ( $V_{grid}$) to a grid that controls movement of charges from charging wires to the surface of the recording member as is well known.

At an exposure station 34, projected light from a write head dissipates the electrostatic charge on the photoconductive belt to form a latent image of a document to be copied or printed. The write head preferably has an array of light-emitting diodes (LEDs) or other light source for exposing the photoconductive belt picture element (pixel) by picture element with an intensity regulated by a programmable controller 36 as determined by LCU 24. Alternatively, the exposure may be by optical projection of an image of a document or a patch onto the photoconductor. A still further alternative is creating electrostatic latent images using needle-like electrodes or other known means for forming such latent images.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to a writer interface 32 for identifying exposure correction parameters in a look-up table (LUT) for use in controlling image density. In order to form patches with density, the LCU may be provided with ROM memory representing data for creation of a patch that may be input into the data source 36. Travel of belt 18 brings the areas bearing the latent charge images into a development station 38. The development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46 as is also well known is provided for moving a receiver sheet S into engagement with the photoconductor in register with the image for transferring the image to a receiver. Alternatively, an intermediate member may have the image transferred to it and the image may then be transferred to the receiver. A cleaning station 48 is also provided subsequent to the transfer station for removing toner from the belt 18 to allow reuse of the surface for forming additional images. In lieu of a belt a drum photoconductor or other structure for supporting an image may be used. After transfer of the unfixed toner images to a receiver sheet, such sheet is transported to a fuser station 49 where the image is fixed.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices.

Figure 2:
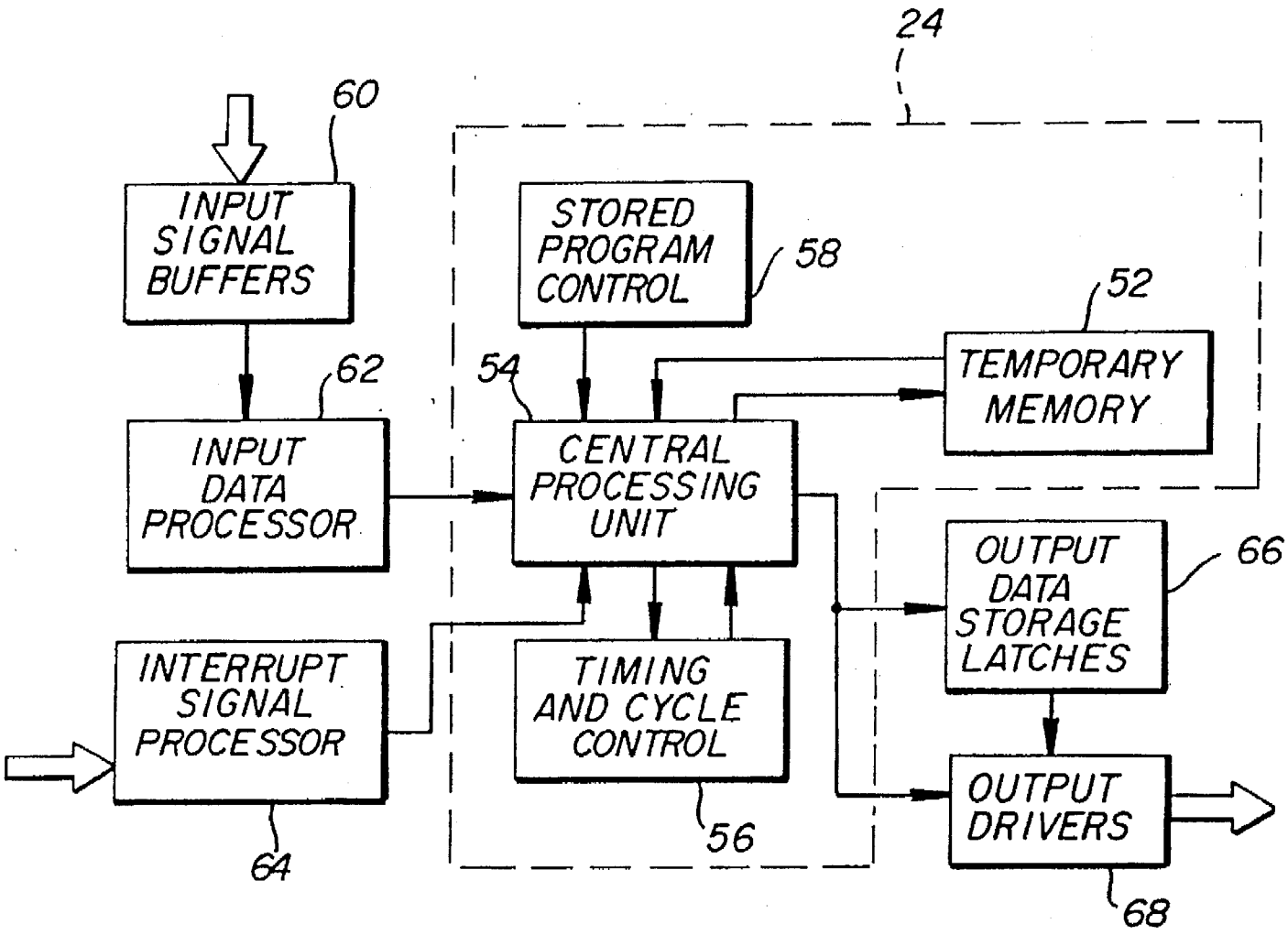
FIG. 2 is a block diagram of the logic and control unit shown in FIG. 1.

Referring to FIG. 2, a block diagram of a typical LCU 24 is shown. The LCU comprises temporary data storage memory 52, central processing unit 54, timing and cycle control unit 56, and stored program control 58. Data input and output is performed sequentially through or under program control. Input data are applied either through input signal buffers 60 to an input data processor 62 or through an interrupt signal processor 64. The input signals are derived from various switches, sensors, and analog-to-digital converters that are part of the apparatus 10 or received from sources external to machine 10.

The output data and control signals are applied directly or through storage latches 66 to suitable output drivers 68. The output drivers are connected to appropriate subsystems.

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of a estimate of toned density. This signal $D_{out}$, may be used to adjust $V_0$, $E_0$, or $V_B$; and, as explained below, to assist in the maintenance of the proper concentration of toner particles in the developer mixture.

In the preferred embodiment, the density signal is used to detect short term changes in density of a measured patch to control primary voltage $V_0$, $E_0$ and/or $V_B$. To do this, $D_{out}$ is compared with a set point density value or signal D (SP) and differences between $D_{out}$ and D(SP) cause the LCU to change settings of $V_{grid}$ on charging station 28 or adjust exposure through modifying exposure duration or light intensity for recording a pixel and/or adjustment to the potential $V_B$ at the development station. These changes are in accordance with values stored in the LCU memory, for example, as a look-up table.

Figure 5:
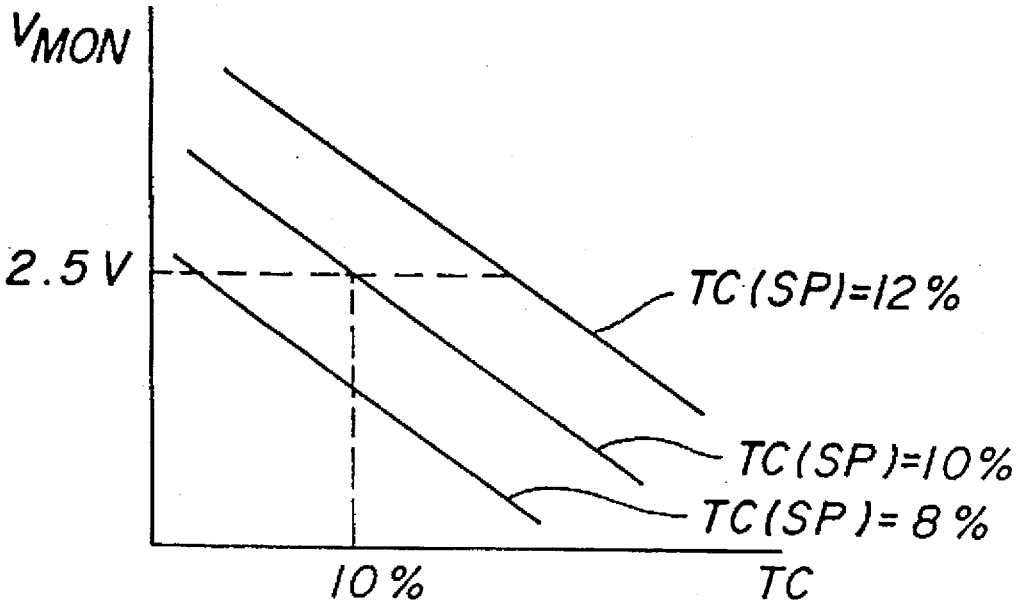
FIG. 5 is a graph illustrating a relationship between toner concentration (TC) and a signal output by a toner concentration monitor in accordance with the embodiment of FIG. 1.

In accordance with the invention, long term changes in toning contrast are compensated by adjustment of the toner concentration (TC) setpoint of a TC controller 57. The TC controller, in turn, adjusts the short term rate of toner replenishment. In a two-component developer provided in development or toning station 38, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration that is less than that of a set point value. For example, a toner monitor probe is a transducer that is located or mounted within or proximate the development station and provides a signal related to toner concentration. This signal is input to a toner monitor which in a conventional toner monitor causes a voltage signal $V_{MON}$ to be generated in accordance with a predetermined relationship between $V_{MON}$ and TC (see FIG. 6). The voltage $V_{MON}$ is then compared with a fixed voltage of say 2.5 volts which would be expected for a desired toner concentration of say 10%. Differences of $V_{MON}$ from this fixed voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices. With reference to FIG. 5, a particular parametric relationship between TC and $V_{MON}$ may be selected in accordance with a voltage input representing a toner concentration set point signal value, TC(SP). Thus changes in TC(SP) can affect the rate of replenishment by affecting how the system responds to changes in toner concentration that is sensed by the toner monitor. The generation of the signal TC(SP) and how it affects the toner replenishment in accordance with the invention will now be described.

Figure 3:
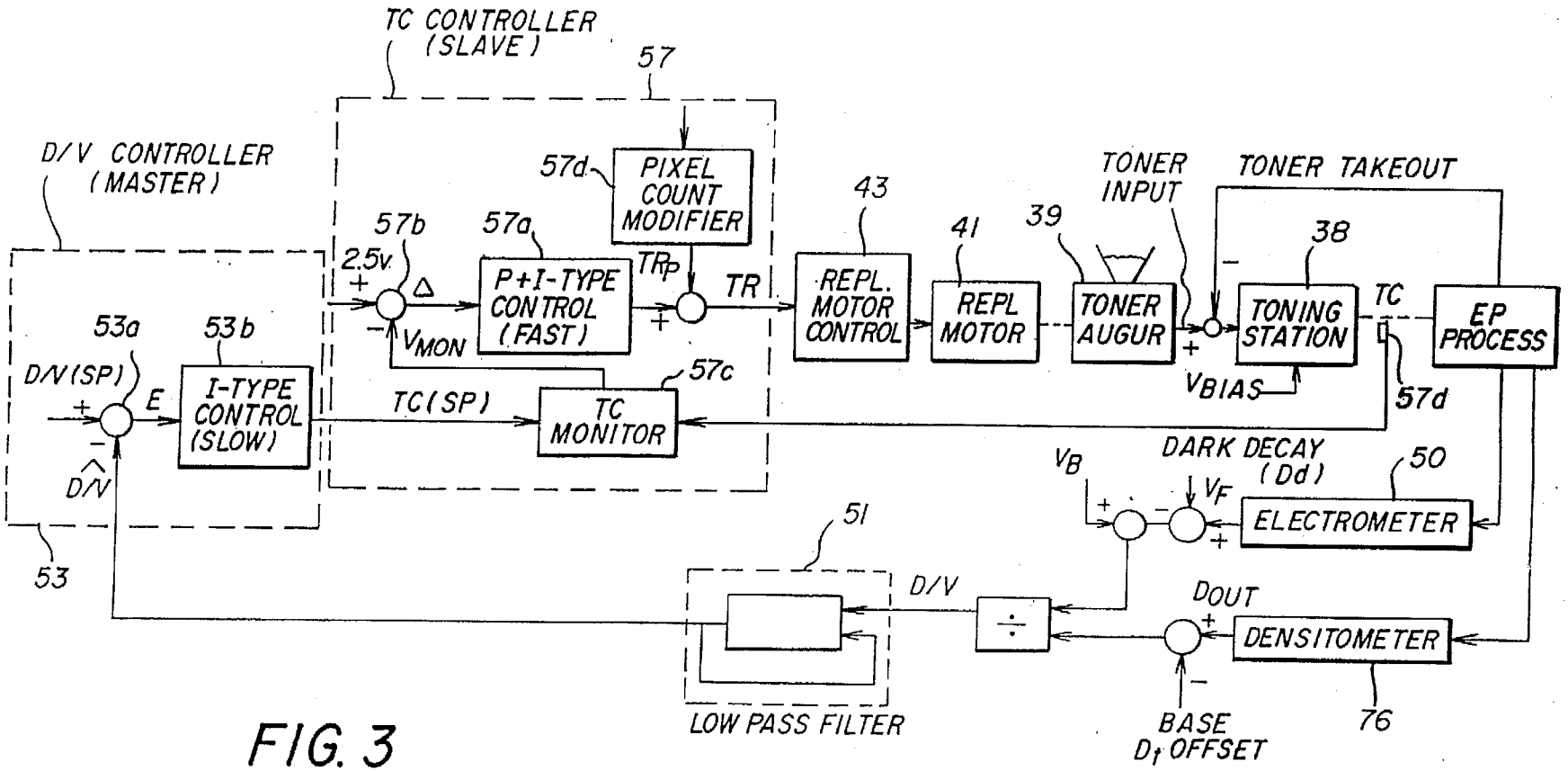
FIG. 3 is a block diagram of a process for deriving a development station replenishment control signal for the electrostatographic machine of FIG. 1.
Figure 4A:
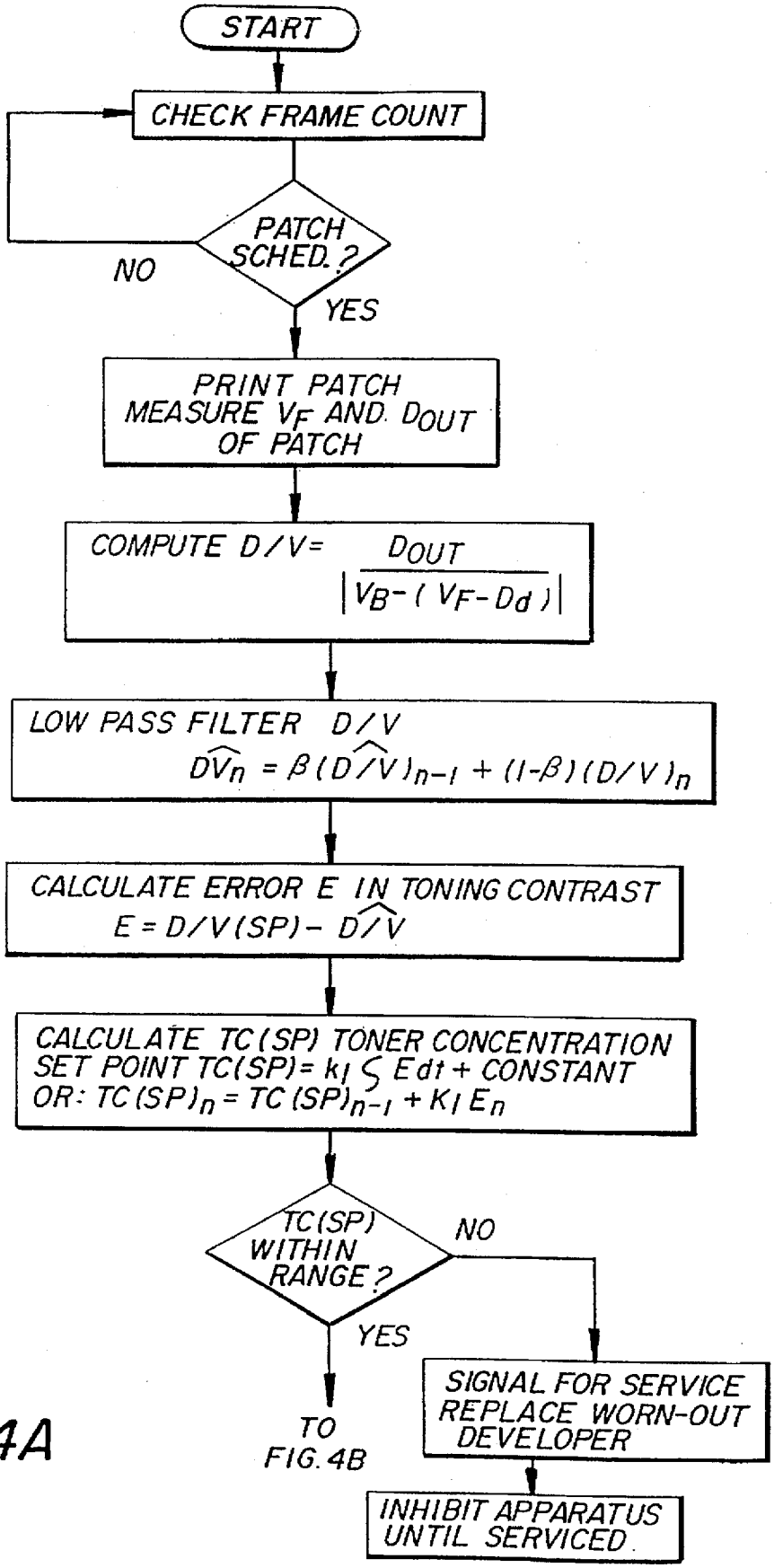
FIG. 4A and 4B are a flowchart of the process for deriving a development station replenishment control signal for the machine of FIG. 1.
Figure 4B:
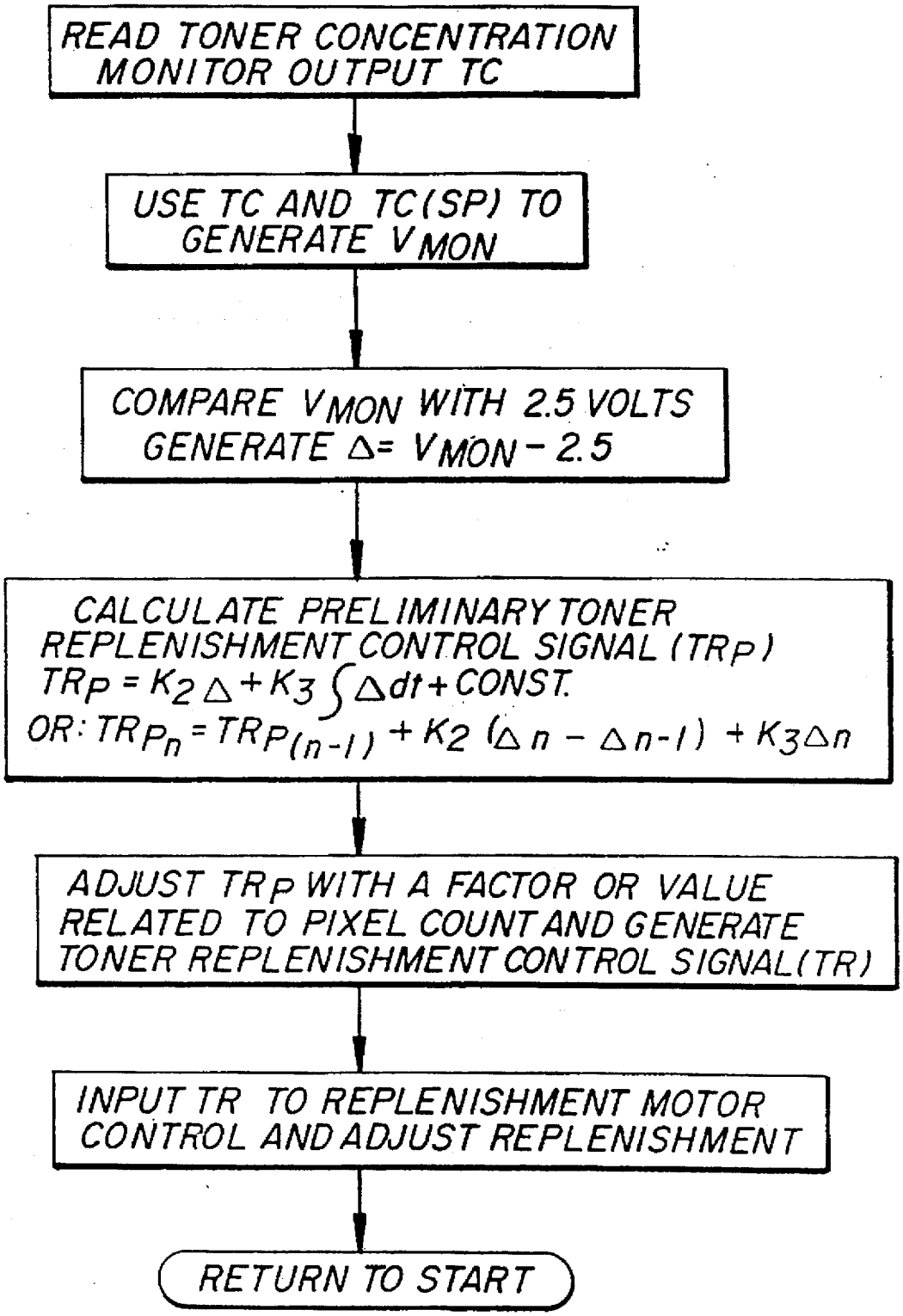

With reference now to FIGS. 1, 3 and the flowchart of FIGS. 4A and 4B, the LCU is programmed to periodically enter a patch creation mode wherein a patch of predetermined nominal density is formed; i.e., by exposure and development with toner on the web preferably in an interframe area. After the patch is exposed, the charge remaining on the exposed area of the patch prior to development is measured by an electrometer 50 which generates a signal $V_F$ or, as noted above, $V_F-D_d$. The density of the patch $D_{OUT}$ (preferably transmission density) after development of the patch is measured and used to adjust $V_o$, $V_B$, etc. as noted above but is also used to determine the value of toning contrast (D/V) for the creation of this patch. Note that measured $D_{out}$ also may be adjusted for transmission losses of light used to measure $D_{out}$ and caused by the passing of this light through the web. Generally, the value D/V may be computed as $D_{out}/|V_B-V_F|$. A more precise value of D/V may instead be calculated by considering dark decay. Thus, in considering dark decay $D/V=D_{out}/|V_B-(V_F-D_d)|$. For each patch several values of toning contrast are generated based on reading of different portions of the patch so that a signal representing such values may be averaged before being passed through a low pass filter 51. The filter 51 may operate on the present toning contrast signal for the current patch accordance with a relationship wherein the output of the filter 51 $_n=\beta()_{n-1}+(1-\beta)(D/V)_n$; wherein $()_{n-1}$ represents a filtered value of toning contrast for the prior patch and $(D/V)_n$ represents toning contrast calculated for the current patch preferably as an average for the patch. The value $\beta$ is a constant that may be set between 0 and 1. Typically, where large process or measurement noises adversely affect the computed toning contrast, $\beta$ will be closer to 1. For the initial calculation of , $\beta$=O.

The output of the filter 51 is a signal representing a filtered value of toning contrast D/V, which is then compared with a set point value for toning contrast D/V(SP) that is determined experimentally. The value D/V (SP) may be a constant or a value that changes with age of the developer mix and/or relative humidity (RH). Where it is made to change a look-up table may be associated with the LCU for changing D/V(SP) with the parameters of developer age or RH. A difference between the two values represents an error E and this error is integrated over time by an integral controller or integral control algorithm operating as an integral controller. The integral controller is tuned or set to provide a relatively slow response at its output in response to signals at its input. A comparator **53*a* for generating the error signal E and the integral controller 53*b* form a first stage of a two-stage cascaded control for generating the toner replenishment signal. The first stage 53 provides an output signal representing a toner concentration set point signal TC (SP) that is input to the toner concentration monitor of a type having characteristics similar to that of FIG. 5**.

In order to clarify the above-described steps, example calculations will be shown beginning with the exposure of a patch and continuing through the adjustment in TC(SP), in response to the electrometer and densitometer readings of that patch. Patches are exposed at intervals as scheduled in the LCU. The scheduled patches may be at fixed print intervals or at variable intervals according to the rest/run history just prior. Patches may be written at shorter intervals during start-up after a long rest, so that more frequent patch measurements can be taken during such a start-up phase, when imaging characteristics such as toning contrast tend to change rapidly. More frequent process adjustments to $V_o$, $V_B$, and E, for example, may then be computed from the more frequent measurements, as may be required to precisely compensate for the fast-changing imaging characteristics. After a patch is exposed, it passes the electrometer 50 which generates a signal $V_F$. Suppose, for example, that a $V_F$ signal represents a surface potential on the belt 18 of 200 volts. Note this may be an average of more than one reading of this particular patch. The nominal dark decay, $D_d$, occurring during the transit time from the electrometer to the toning station has been previously determined to be, say, 5.0 volts and this value is saved in the LCU. The patch surface potential when it reaches the toning zone is therefore estimated as 200–5=195 volts, in this example. After the electrometer measurement, the patch is toned by the development station. Let us assume that the bias voltage on the development station in this example is $V_B$=400 volts. After toning, the patch passes the densitometer 76. The gross transmission densitometer reading for the toned patch is say 4.0 volts. Suppose further that the densitometer reading for this area of the belt without toner has been previously measured as 1.0 volts, and saved in the LCU. The net toner density of the patch is then computed as 4.0–1.0=3.0 volts. The toning contrast, D/V is then computed for this patch as 3.0/(400–(200–5))=3.0/205=0.0146.

To smooth the effects of random measurement noise, this value is input to a low-pass filter calculation to generate a filtered calculation of D/V, designated . Suppose that the previous calculation of or $()_{n-1}$ was 0.0150, and that the filter factor $\beta$=0.75. The new value is then computed as =0.75×0.0150+(1–0.75)×0.0146=0.0149. Suppose the desired value for is D/V (SP)=0.0145. The error is computed as E=0.0145–0.0149=–0.0004. This negative error indicates that currently DN is slightly high (because of long-term aging or possibly other, short-term effects).

The error E is input to the "master" controller **53*b*** of the integral type which computes an adjusted TC (SP). The integral type controller, for simplicity of calculation purposes, may operate in accordance with the following equation TC (SP)n=TC(SP)$n_{-1+K1}$En. Suppose that the previous value of TC(SP) was 10% and that the gain constant $K_1$=2.0. The new TC(SP) or TC(SP)n is computed as TC(SP)n=10+2.0×(−0.0004)=9.9992. The value of $K_1$ is small, so that individual adjustments $K_1$×E are small for reasonable E values. Cumulative adjustments over short-term changes in environment and duty cycle are also small. But over the long-term, cumulative changes may be large (up to several % TC) as the developer ages. The numerical value required for $K_1$ will depend upon the frequency of adjustment (patch frequency). In our example, the TC adjustment is $K_1$×E=−0.0008% TC. This one adjustment is not a significant change in TC(SP). However, suppose the value of E=−0.0004 (on average) persists over several days and 1000 patches. The 1000 patches might represent, say, 100,000 prints at an average patch frequency of 1 patch every 100 prints. Then, the cumulative adjustment would be −0.8% TC, which is a small but significant change over this period, and would tend to counteract the effects of aging.

The signal TC(SP) thereby serves to determine which line or curve of FIG. 5 is used to establish a predetermined relationship between an output signal $V_{MON}$ from the toner concentration monitor 57*c* and an input signal to the monitor from the TC monitor's probe 57*d*. While only three lines are illustrated in FIG. 5, it should be understood that there could be many more lines or even a continuum of such lines. Print-to-print changes in toner usage relative to replenishment can cause TC to change quickly, producing rapid changes in the $V_{MON}$ signal. The signal $V_{MON}$ is compared by a comparator 57*b* with a constant of say 2.5V and a difference signal Δ is input to a proportional plus integral (P+I) type controller 57*a* or algorithm that operates as such a controller. The P+I controller is tuned for a relatively fast response to input signals Δ. Like $V_{MON}$, Δ may change quickly owing to print-to-print variation in toner usage. The output from the P+I controller 57*a* represents a preliminary toner replenishment signal $TR_p$. The signal $TR_p$ may be modified with a signal that provides adjustment for toner take out based on pixel count. Where the exposure system relies on electro-optical exposure of the photoconductive belt the take out of toner will be related to the number of pixels exposed, assuming that this is a discharged area development process. Where the electro-optical exposure source is of a gray level or multibits per pixel, the count signal may keep track of accumulating grey level exposures and weigh the count accordingly so as to be related to toner take out. The use of pixel counting to modify a toner replenishment signal is known as discussed above and is considered to be optional to the process and apparatus of this invention. The TC monitor comparator 57*b*, P+I controller 57*a* and pixel count modifier 57*d* form the second or slave stage of the two-stage cascaded feedback control system which is used to generate the toner replenishment signal TR. For simplicity of calculations, the P+I controller may operate according to the equation $TR_{pn}=TR_{p(n-1)}+K_2(\Delta_n-\Delta_{(n-1)})+K_3\Delta_n$ wherein $TR_{pn}$ is the current preliminary toner replenishment signal, $TR_{p(n-1)}$ is the previously calculated preliminary toner replenishment signal, $\Delta_n$ is the current difference between $V_{MON}$ and 2.5, $\Delta_{(n-1)}$ is the previously calculated difference between $V_{MON}$ and 2.5, and $K_2$ and $K_3$ are constants.

The best values for $K_2$ and $K_3$ depend on the TC monitor sensitivity S, and the replenisher gain G, which can be ascertained by the methods described below. For best TC regulation in a given configuration, $K_2$ and $K_3$ can be set so that the overall gain products $K_2SG$ and $K_3SG$ are predetermined optimal values determined experimentally or through simulation methods.

Figure 6:
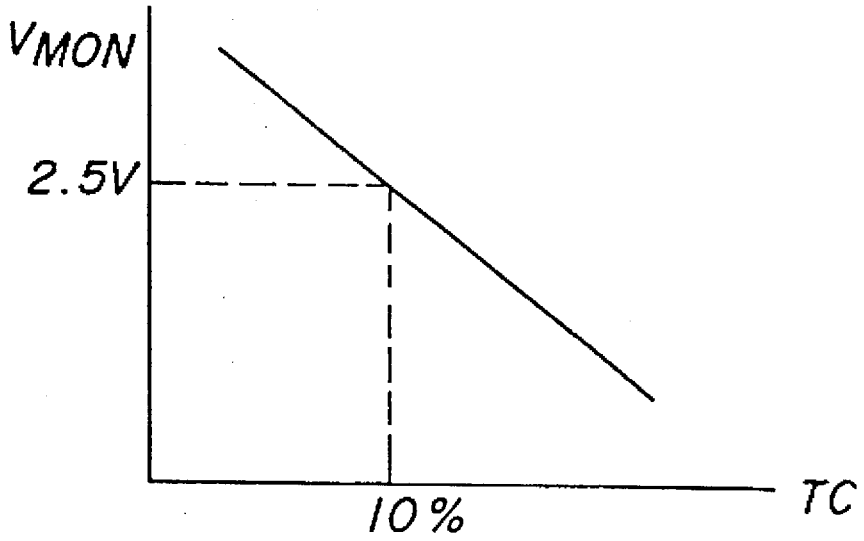
FIG. 6 is a similar graph to that of FIG. 5 but represents a relationship between TC and a signal output by a TC monitor in accordance with another embodiment of the invention.

The method and apparatus of the invention may also be used with a toner monitor of the type having a characteristic of that illustrated in FIG. 6; i.e., a fixed parametric relationship is provided between $V_{MON}$ and measured TC. Where such a toner monitor is used the signal of TC(SP) output from the D/V master controller 53 is input into one input of comparator 51*b* in lieu of the constant signal of 2.5 volts and thus TC(SP) is compared with $V_{MON}$ to generate the signal Δ.

The invention thus provides a cascaded two stage feedback control system for generating a toner replenishment signal. The master portion of the system is a toning contrast feedback controller that operates on changes in toning contrast from a set point to generate a toner concentration set point signal. A second part of the cascaded feedback control system or slave portion involves feedback of toner concentration measurements and generation of a toner replenishment signal by a slave feedback controller that is responsive to the output of the master toning contrast controller 53 and the feedback signal of the toner concentration.

There is thus provided a novel control system that overcomes problems noted in the prior art and that may be implemented either by hardware and/or a suitably programmed computer or microcomputer.

Thus, a new method and apparatus for process control is provided for regulating toning contrast (D/V). At intervals, process control patches are exposed and toned so that an on-board electrometer and an on-board transmission densitometer can read $V_F$ and $D_{out}$, respectively. With the known $V_B$, D/V can then be computed in the machine LCU, and compared to the desired value for D/V. Since there is a direct relationship between TC and D/V, the TC setpoint of the replenishment algorithm is adjusted according to the error in D/V. However, the rate of adjustment of the TC setpoint is limited such that the change in TC is very gradual over developer age. With this limitation, the TC does not change significantly over relatively short-term variations in environment or duty-cycle. The short-term variations in density are rather compensated by immediate adjustments in, for example, charging and/or exposure, while long-term changes are compensated by the gradual adjustment of TC.

One advantage of the above method of D/V regulation is that the burden of process control adjustments is shared in a way that avoids the problems that occur when any one adjustment is changed by an extreme amount. The short-term affects are compensated immediately by adjustments in charging and/or exposure and toning station $V_B$. The longer term effects, owing to developer age, are compensated by regulating D/V. With age, developers tend to decrease in charge-to-mass ratio (Q/M), and increase in toning contrast (D/V). To compensate for this aging effect, TC is gradually decreased, and D/V is maintained constant, except for the short-term fluctuations. By avoiding the extremes in replenishment which would be required to rapidly change TC, the developer mix tribocharges more consistently and dusting is minimized.

A further advantage is that the gradually decreasing TC tends to slow or delay the decrease in Q/M with age, keeping dust and background reasonably low for a longer time. Two-component developers in general display aging behavior of the triboelectric charging ability of the carrier, in that charging rate and equilibrium charge level decrease with usage. The physical cause is usually scumming of the carrier surface with the toner material. Decreasing TC enhances the rate of charging, counteracting the effects of aging.

Therefore, the developer need not be replaced until much later, compared to operating at a fixed TC throughout developer life.

The parametric relationships between TC and $V_{MON}$ illustrated in FIGS. 5 and 6 are generally based on nominal assumptions based either on data from the manufacturer or experience with toner monitors in general. In accordance with the improved method described in the cross-referenced application, further improved TC control may be obtained by reducing the uncertainty in toner concentration monitor sensitivity and in replenisher gain. Replenisher gain is related to control of the auger feed and involves weight of toner delivered per unit on time of the auger. In accordance with the improved method, the development station is loaded with a known weight of fresh developer and the percent of TC is also known. Preferably the initial toner concentration is made to be the same as the desired TC(SP). The probe of the toner monitor is mounted on or in the development station in its position for normal use. The initial monitor output voltage $V_{MON}$ is noted by the machine logic. A check is made of the imaging by the usual methods, assuring that the copier or printer is set up to produce normal $D_{max}$ and tone scale. Then, a first calibration run is made that depletes a predetermined weight of toner from the development station. In this run a standard reference print of known toner usage per print is printed for a predetermined number of prints, using up a known weight of toner from the development station, and reducing the TC by a known percent. No replenishment is done during this first calibration run. The difference in monitor output voltage $V_{MON}$ is noted by the machine logic between the beginning and end of this first calibration run. The logic then computes monitor sensitivity in volts per % change in TC.

The replenisher gain is calibrated in a second calibration run, immediately following the first calibration run that was used for determining monitor sensitivity. Without toning any images, the replenisher 39 is actuated. Toner is delivered, a little at a time, to the toning station where it is mixed uniformly into the developer. The monitor output voltage $V_{MON}$ changes as TC builds up. When $V_{MON}$ reaches the value noted initially at the start of the first calibration run, the TC is again at the initial nominal value. The weight of toner used (and then replenished) and the change in TC resulting is predetermined by the number of reference prints. The machine logic computes the replenisher gain, G, as the change in TC divided by the total replenisher 'ON' time. The replenisher gain, G, is saved for use in determining the overall gain products of the feedback system as described above.

The invention has been described in detail with particular reference to preferred embodiments thereof, but it will be understood that variations and modifications can be effected within the spirit and scope of the invention.

What is claimed:

1. For use in a electrostatographic machine wherein images are formed on an electrostatic image supporting medium and developed by a development station having a developer formed of a mixture of toner and carrier particles, the machine including apparatus for controlling various processing control parameters in response to formation of toned areas on the medium, said apparatus comprising:

a first feedback control means for processing signals related to a parameter toning contrast in accordance with a closed loop control of said parameter, said first feedback control means including means for outputting a first signal in response to closed loop control of said parameter; and a second feedback control means slaved to said first feedback control means and responsive to sensing of toner concentration in the development station and to said first signal for controlling toner concentration in accordance with closed loop control of toner concentration, said second feedback control means outputting a second signal in response to closed loop control of toner concentration for use in controlling replenishment of toner to the development station and thereby controlling toning contrast.

2. The control means of claim 1 in combination with replenishment means for feeding of toner to the development station, said replenishment means being responsive to said second signal for adjusting feeding of toner to the development station in response to said second signal.

3. The combination of claim 2 and wherein the replenishment means includes an auger for advancing toner to the development station; a motor connected to the auger for driving the auger; and a motor control connected to the motor for controlling a duty cycle of operation of the motor in response to said second signal.

4. The combination of claim 3 in further combination with the electrostatic image supporting medium; a writer means for forming latent electrostatic images on said image supporting medium; the development station for developing the latent electrostatic image; and means for transferring a developed image to a receiver sheet.

5. The apparatus of claim 1 including means for calculating toning contrast of a patch and means for low pass filtering calculated values of toning contrast and means for providing filtered values of toning contrast as a feedback signal for control of said parameter.

6. The apparatus of claim 5 including means for comparing filtered values of toning contrast with a toning contrast set point and generating an error representing differences between filtered values of toning contrast and the toning contrast set point and means for integrating errors with time to generate said first signal.

7. The apparatus of claim 6 and said second feedback control means including a probe for generating a third signal related to toner concentration and a toner concentration monitor means for generating an output signal, said monitor means including a first input terminal for receiving the third signal from the probe and a second input terminal for receiving said first signal; said toner concentration monitor means adjusting a parametric relationship between said output signal and said third signal.

8. The apparatus of claim 7 and including means for comparing said output signal with a constant value and generating difference values and means for integrating said difference values to generate the second signal.

9. The apparatus of claim 7 and including means for comparing said output signal with a constant value and generating difference values and means for integrating said difference values to generate a preliminary toner replenishment signal and means for adjusting said preliminary toner replenishment signal in response to pixel count to generate said second signal.

10. A method for use in an electrostatographic process wherein images are formed on an electrostatic image supporting medium and developed by a development station having a developer formed of a mixture of toner and carrier particles, the method comprising the steps of:

exposing the medium at an area to form a latent image of a patch;

developing the patch at the development station;

in response to a characteristic of said patch controlling a parameter toning contrast in forming said image in accordance with closed loop feedback control of signals related to said parameter and outputting a first signal in response to said closed loop control of said signals related to said parameter;

sensing toner concentration in said development station;

in response to sensing of toner concentration in said development station and in response to said first signal controlling toner concentration in said development station and thereby controlling toning contrast by outputting a second signal that is generated in response to closed loop feedback control of signals related to toner concentration.

11. The method of claim 10 and including the steps of adjusting feeding of toner to said development station in response to said second signal.

12. The method of claim 10 and including calculating toning contrast of a patch, low pass filtering calculated values of toning contrast, and providing filtered values of toning contrast as a feedback signal for control of said parameter.

13. The method of claim 12 and including comparing filtered values of toning contrast with a toning contrast set point and generating an error representing differences between filtered values of toning contrast and the toning contrast set point and integrating errors with time to generate said first signal.

14. The method of claim 13 and including monitoring toner concentration in said development station and generating an output signal from said monitoring in response to a third signal related to toner concentration in said development station and in response to said first signal adjusting a parametric relationship between said output signal and said third signal.

15. The method of claim 14 and including comparing said output signal with a constant value and generating difference values and means for integrating said difference values to generate the second signal.

16. The method of claim 14 and including comparing said output signal with a constant value and generating difference values, integrating said difference values to generate a preliminary toner replenishment signal; and adjusting said preliminary toner replenishment signal in response to pixel count to generate said second signal.

17. The method of claim 10 and wherein said first signal is a toner concentration set point value.

18. A method for use in an electrostatographic process wherein images are formed on an electrostatic image supporting medium and developed by a development station having a developer formed of a mixture of toner and carrier particles, the method comprising the steps of:

exposing the medium at an area to form a latent image;

developing the image at the development station;

in response to a characteristic of said image controlling a parameter toning contrast in forming said image in accordance with closed loop feedback control of signals related to said parameter and outputting a first signal in response to said closed loop control of said signals related to said parameter;

sensing toner concentration in said development station;

in response to sensing of toner concentration in said development station and in response to said first signal controlling toner concentration in said development station and thereby controlling toning contrast by outputting a second signal that is generated in response to closed loop feedback control of signals related to toner concentration.

19. The method of claim 18 and wherein said first signal is a toner concentration set point value.

* * * * *

UNITED STATES PATENT AND TRADEMARK OFFICE

CERTIFICATE OF CORRECTION

PATENT NO. :5,678,131

DATED :OCTOBER 14,1997

INVENTOR(S) :PETER S. ALEXANDROVICH, ET AL.

It is certified that error appears in the above-identified patent and that said Letters Patent is hereby corrected as shown below:

Title page, insert the following:

--Related U. S. Application Data

[60] Provisional application No. 60/002,661, August 22, 1995—

Column 1, line, 6, insert the following:

--CROSS REFERENCE TO RELATED APPLICATION

Reference is made to and priority claimed from U. S. Provisional application Ser. No. US60/002,661, filed August 22, 1995, entitled APPARATUS AND METHOD FOR REGULATING TONING CONTRAST AND EXTENDING DEVELOPER LIFE BY LONG-TERM ADJUSTMENT OF TONER CONCENTRATION--.

Signed and Sealed this

Sixth Day of July, 1999

*Attest:*

Q. TODD DICKINSON

*Attesting Officer*

*Acting Commissioner of Patents and Trademarks*